US009624929B2

(12) United States Patent
Kim

(10) Patent No.: US 9,624,929 B2
(45) Date of Patent: Apr. 18, 2017

(54) ELECTRIC PUMP

(71) Applicant: LG INNOTEK CO., LTD., Seoul (KR)

(72) Inventor: Chanseok Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 324 days.

(21) Appl. No.: 14/132,033

(22) Filed: Dec. 18, 2013

(65) Prior Publication Data

US 2014/0178219 A1 Jun. 26, 2014

(30) Foreign Application Priority Data

Dec. 21, 2012 (KR) ..... 10-2012-0151050
Jul. 23, 2013 (KR) ..... 10-2013-0086787

(51) Int. Cl.

| | |
|---|---|
| ***F04C 29/06*** | (2006.01) |
| ***F01C 21/10*** | (2006.01) |
| ***F04C 2/10*** | (2006.01) |
| ***F04C 15/06*** | (2006.01) |
| ***F04C 27/00*** | (2006.01) |
| *F04C 15/00* | (2006.01) |

(52) U.S. Cl.

CPC ..... *F04C 29/068* (2013.01); *F01C 21/10* (2013.01); *F04C 2/10* (2013.01); *F04C 2/102* (2013.01); *F04C 15/008* (2013.01); *F04C 15/06* (2013.01); *F04C 27/006* (2013.01); *F04C 15/0038* (2013.01); *F04C 2240/51* (2013.01); *F04C 2240/808* (2013.01)

(58) Field of Classification Search

CPC ..... F04C 29/068; F04C 2/10; F04C 2/102; F04C 15/008; F04C 15/06; F04C 15/0038; F04C 27/006; F04C 2240/51; F04C 2240/808; F01C 21/10; F04D 29/40; F04D 15/0011; F04D 27/0215

USPC ..... 417/423.14

See application file for complete search history.

(56) References Cited

U.S. PATENT DOCUMENTS 1,911,128 A * 5/1933 Apple ..... F04C 11/008 310/66
2,212,417 A * 8/1940 George ..... F04C 2/1073 417/410.3
4,457,677 A * 7/1984 Todd ..... F04C 2/105 417/310

(Continued)

FOREIGN PATENT DOCUMENTS

CN 1826470 8/2006
CN 10-1663483 3/2010

(Continued)

OTHER PUBLICATIONS

Chinese Office Action dated Nov. 1, 2016 issued in Application No. 201310719017.8 (English translation attached).

(Continued)

*Primary Examiner* — Theodore Stigell
*Assistant Examiner* — Jon Hoffmann
(74) *Attorney, Agent, or Firm* — KED & Associates LLP

(57) ABSTRACT

An electric pump includes a housing and a motor unit having a stator disposed in the housing. A rotor is rotatably disposed on the stator and a rotating shaft is inserted in and passing through the rotor. A pump comprises an inner rotor coupled to one end of the rotating shaft and an outer rotor, and the pump has an inserting recess for receiving the pump.

11 Claims, 6 Drawing Sheets

(56) References Cited

U.S. PATENT DOCUMENTS 4,543,789 A * 10/1985 Norton ..... B60T 13/16 303/10
6,174,151 B1 * 1/2001 Yarr ..... F01C 1/103 137/469
6,347,843 B1 * 2/2002 Murayama ..... B60T 8/348 303/10
6,368,086 B1 * 4/2002 McInerney ..... F01C 21/10 418/104
6,769,889 B1 * 8/2004 Raney ..... F04C 2/102 384/278
7,220,111 B2 * 5/2007 Johnson ..... F04C 2/086 29/888.023
7,290,995 B2 * 11/2007 Ohnishi ..... F04C 2/102 29/888.02
7,427,191 B2 * 9/2008 Kurata ..... F04C 2/086 418/133
7,669,577 B2 * 3/2010 Rosso ..... F04C 2/102 123/200
7,857,606 B2 * 12/2010 Chiu ..... F04C 2/102 418/19
8,714,951 B2 * 5/2014 Yarr ..... F01C 1/084 418/150
8,840,385 B2 * 9/2014 Lipinski ..... F04C 2/084 418/152
8,851,578 B2 * 10/2014 Kawabata ..... B60T 8/4031 303/10
8,876,504 B2 * 11/2014 Uozumi ..... F04C 2/084 418/150
8,920,148 B2 * 12/2014 Nakagawa ..... F04C 2/088 418/160
8,956,133 B2 * 2/2015 Ogata ..... F04C 2/102 418/171
9,127,671 B2 * 9/2015 Ono ..... F04C 2/086
9,127,673 B2 * 9/2015 Krampe ..... F04C 2/086
2001/0026767 A1 * 10/2001 Takagi ..... F04C 15/0049 418/109
2003/0070879 A1 * 4/2003 Pringle ..... F04C 2/102 184/6.28
2004/0071559 A1 * 4/2004 Ai ..... F04C 15/0057 417/220
2005/0088041 A1 * 4/2005 Dong ..... F03C 2/08 303/116.4
2006/0210417 A1 * 9/2006 Kurata ..... F04C 2/102 418/61.3
2006/0255674 A1 * 11/2006 Chen ..... F16C 33/103 310/90
2007/0096550 A1 * 5/2007 Yamaguchi ..... B60T 8/4031 303/10
2007/0188034 A1 * 8/2007 Yoshida ..... F04D 29/063 310/90
2007/0253855 A1 * 11/2007 Tsubono ..... F04C 2/084 418/61.3
2007/0277189 A1 * 11/2007 Yasumoto ..... G11B 17/0282 720/710
2007/0290571 A1 * 12/2007 Yoon ..... G11B 25/043 310/261.1
2008/0159884 A1 * 7/2008 Nakanishi ..... F04C 2/084 417/410.4
2008/0159885 A1 * 7/2008 Kameya ..... F04C 2/102 417/410.4
2008/0224554 A1 * 9/2008 Hiwa ..... F16C 33/107 310/90
2009/0175751 A1 * 7/2009 Nakayoshi ..... F04C 2/086 418/171
2009/0226298 A1 * 9/2009 Kajiyama ..... B60T 8/4031 415/65
2010/0008797 A1 * 1/2010 Yukitake ..... F04C 2/102 417/310
2010/0028172 A1 * 2/2010 Heuver ..... F04C 2/10 417/364
2010/0054965 A1 * 3/2010 Teshima ..... F04D 29/057 417/354
2010/0111742 A1 * 5/2010 Petersen ..... F04C 15/0096 418/88
2010/0119398 A1 * 5/2010 Orlandi ..... F04C 2/102 418/60
2010/0129239 A1 * 5/2010 Hadar ..... F04C 2/102 417/410.4
2010/0129253 A1 * 5/2010 Nunami ..... F04C 2/102 418/61.3
2010/0158734 A1 * 6/2010 Hosono ..... F04C 2/102 418/61.3
2010/0172768 A1 * 7/2010 Liao ..... F04C 2/102 417/321
2010/0183454 A1 * 7/2010 Lubke ..... F04C 2/102 417/310
2010/0290934 A1 * 11/2010 Hadar ..... F04B 17/03 417/410.4
2010/0322810 A1 * 12/2010 Schepp ..... B60T 8/4031 418/199
2011/0027115 A1 * 2/2011 Oh ..... F04C 29/06 418/55.1
2011/0116939 A1 * 5/2011 Kawabata ..... B60T 8/4031 417/253
2011/0135516 A1 * 6/2011 Oishi ..... F01C 21/02 417/410.4
2011/0163621 A1 * 7/2011 Kim ..... G11B 19/2009 310/90
2011/0229361 A1 * 9/2011 Kuroda ..... F04C 2/084 418/166
2011/0250086 A1 * 10/2011 Sakurai ..... F04C 2/103 418/61.3

FOREIGN PATENT DOCUMENTS

| | | |
|---|---|---|
| EP | 2 078 859 | 7/2009 |
| JP | 2010-007516 | 1/2010 |
| KR | 10-0680364 B1 | 2/2007 |
| KR | 10-0868615 B1 | 11/2008 |

OTHER PUBLICATIONS

European Search Report dated Nov. 2, 2016 issued in Application No. 13198684.6.

* cited by examiner

ELECTRIC PUMP

CROSS-REFERENCE TO RELATED APPLICATION

This application claims priority to and the benefit of Korean Patent Application No. 10-2012-0151050, filed on Dec. 21, 2012 and Korean Patent Application No. 10-2013-0086787, filed on Jul. 23, 2013, the disclosure of which is incorporated herein by reference in its entirety.

BACKGROUND

1. Field

The present application relates to an electric pump.

2. Background

In general, an electric oil pump (EOP) is a device supplying oil into a transmission of a motor vehicle to constantly maintain a pressure in the transmission for smoothly performing a transmission function. In particular, a hybrid electric vehicle (HEV) is disadvantageous in that an engine is stopped when a travelling of a vehicle is completed and thus a pressure in the transmission is not constantly maintained. In order to compensate for the above disadvantage, the above pump is operated to maintain a pressure of oil when an engine is stopped.

In a process for manufacturing the electric oil pump, however, a pump, a motor and an inverter are separately manufactured, the pump and the motor are coupled to each other by bolts and the inverter is connected to the motor and the pump by means of separate cables. Therefore, since the pump, the motor and the inverter are manufactured by separate manufacturers and then assembled, the conventional electric oil pump has unnecessary structure in terms of performance, efficiency and production cost.

In particular, since each part is individually assembled, a size of the electric oil pump is unnecessarily increased and the electric oil pump is vulnerable to vibration. In addition, due to the separate type electric oil pump, a noise fault is increased and an additional member/element (for example, a bushing) is required for securing the reliability at the time of assembling the electric oil pump.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
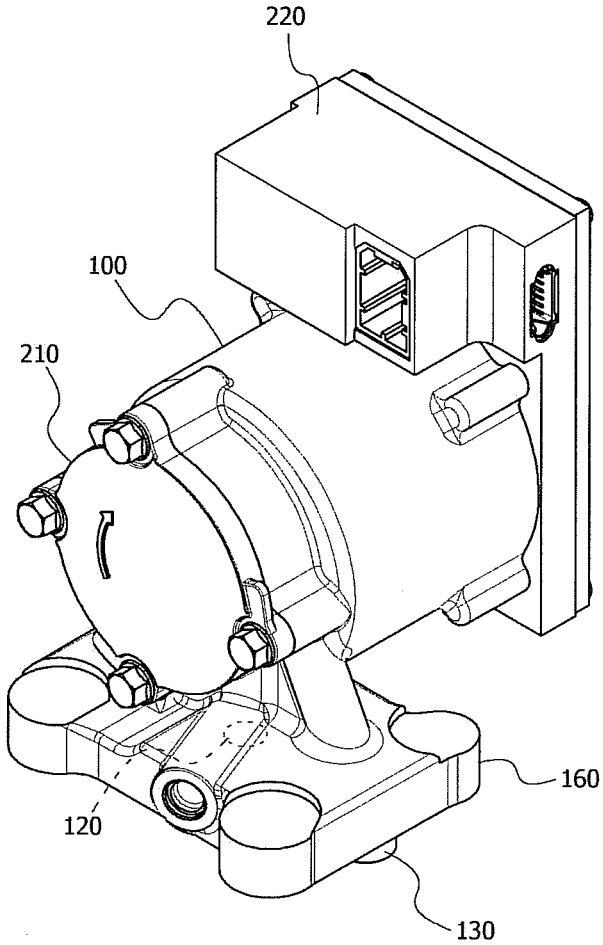
FIG. 1 is a perspective view of an electric pump according to one embodiment of the present application.

Exemplary embodiments of the present application will be described in detail below with reference to the accompanying drawings. While the present application is shown and described in connection with exemplary embodiments thereof, it will be apparent to those skilled in the art that various modifications can be made without departing from the spirit and scope of the application.

Since the present application may be modified in various ways and may have various embodiments, specific embodiments are illustrated in the drawings and are described in detail in the present specification. However, it should be understood that the present application is not limited to specific disclosed embodiments, but includes all modifications, equivalents and substitutes encompassed within the spirit and technical scope of the present application.

The terms including the ordinal numeral such as "first," "second," etc. may be used to describe various components, but the components are not limited by such terms. The terms are used only for the purpose of distinguishing one component from other components. For example, a first component may be designated as a second component without departing from the scope of the present application. In the same manner, the second component may be designated as the first component. The term "and/or" encompasses both combinations of the plurality of related items disclosed and any item from among the plurality of related items disclosed.

When an arbitrary component is described as being "connected" or "linked" to another component, although this may refer to a case in which the arbitrary component is directly connected or linked to the second component, it may also refer to a case in which there is still another component or components therebetween. In contrast, when an arbitrary component is described as being "directly connected" or "directly linked" to another component, this should be understood to mean that there are no other components therebetween.

The terms used in the specification of the present application are used only to illustrate specific embodiments, and are not intended to limit the present application. A singular expression can include a plural expression as long as the context does not indicate otherwise. In the present specification, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

Unless otherwise specified, all of the terms which are used herein, including the technical or scientific terms, have the same meanings as those that are generally understood by a person having ordinary knowledge in the art to which the present application pertains. The terms defined in a generally used dictionary must be understood to have meanings identical to those used in the context of the related art, and are not to be construed to have ideal or excessively formal meanings unless explicitly specified in the present specification.

Hereinafter, the embodiment of the present application will be described in detail with reference to the accompanying drawings. Structural elements which are the same as or correspond to structural elements that have already been illustrated will be indicated by the same reference numeral, and illustration thereof omitted.

Figure 2:
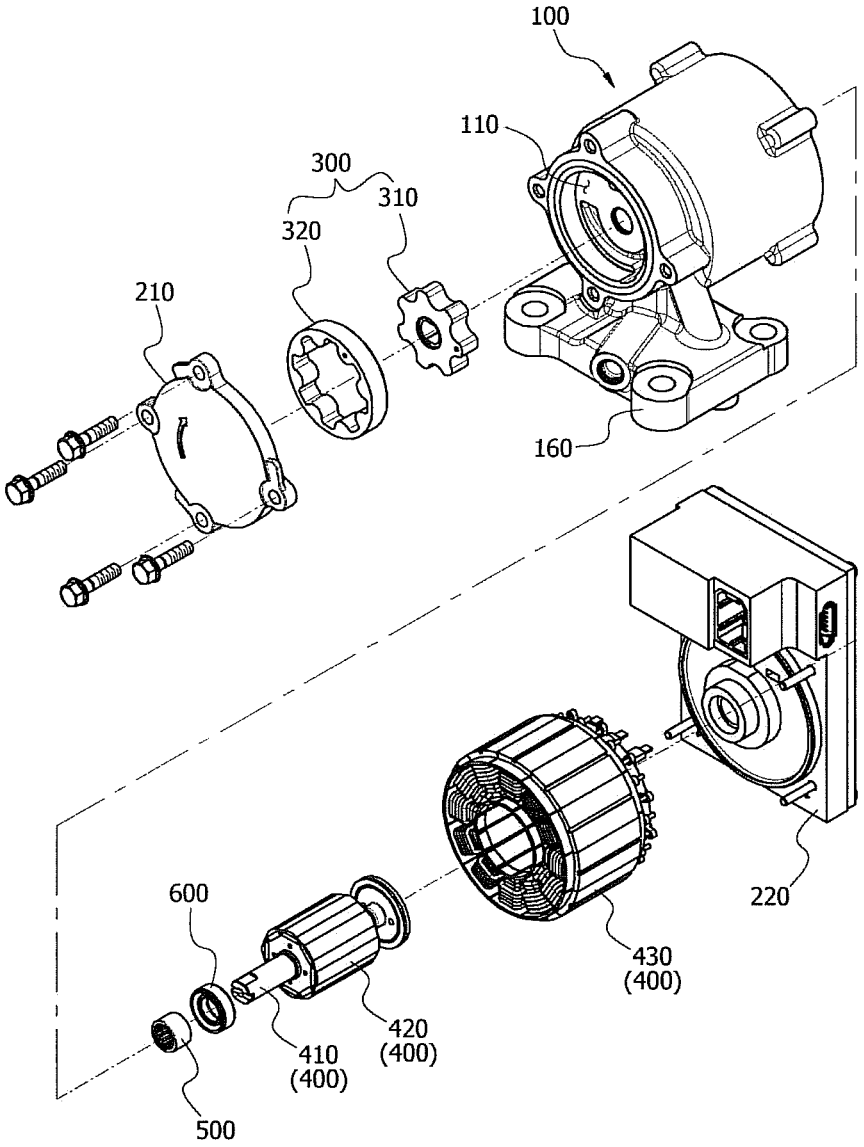
FIG. 2 is an exploded perspective view of an electric pump according to one embodiment of the present application.

FIG. 1 is a perspective view of an electric pump according to one embodiment of the present application and FIG. 2 is an exploded perspective view of an electric pump according to one embodiment of the present application.

Referring to FIG. 1 and FIG. 2, an electric pump according to one embodiment of the present application includes a housing 100; a motor unit 400 including a rotating shaft 410 inserted in the housing 100, a rotor 420 disposed on an outer circumferential surface of the rotating shaft 410 and a stator 430 in which the rotor 420 is received; and a pump unit 300 including an inner rotor 310 coupled to one end of the rotating shaft 410 and an outer rotor 320.

The housing 100 is a cylindrical member and has an inserting recess 110 formed on one side surface thereof to enable the pump unit 300 to be received in the inserting recess. A depth of the inserting recess 110 may be equal to a thickness of the pump unit 300. However, the present application is not necessarily limited thereto, and the housing can be manufactured such that only a certain portion of the pump unit 300 is inserted into the inserting recess 110. One side surface of the housing 100 in which the pump unit 300 is inserted is coupled with a first cover 210 to seal the housing.

A mounting part 160 is formed on the housing 100. As one example of the present application, a structure in which a fluid inlet 120 and a fluid outlet 130 are formed on the mounting part 160 is exemplarily shown. However, locations of the fluid inlet and the fluid outlet are not necessarily limited thereto. In addition, a shape and a location of the mounting part 160 may be variously modified according a user's or designer's choice.

The pump unit 300 includes the inner rotor 310 coupled to one end of the rotating shaft 410 and the outer rotor 320 in which the inner rotor 310 is received. N lobes are formed on an outer surface of the inner rotor 310, and N+1 lobes are formed on the outer rotor 320 so that the inner rotor and the outer rotor are rotated at a rotation ratio of (N+1)/N.

The pump unit 300 has an eccentric configuration when the inner rotor 310 receives a rotational force from the rotating shaft 410 and then is rotated. Due to the above eccentric configuration, a space having a certain volume is formed between the inner rotor 310 and the outer rotor 320 to enable fluid fuel to be conveyed.

In other words, during rotational movement of the rotors, a portion having the increased volume inhales surrounding fluid with a pressure drop, and a portion having the decreased volume discharges fluid with a pressure increment. The well-known structure of the pump unit can applied to the above pump unit of the present application, and thus detailed description thereof is omitted.

The motor unit 400 is inserted into the other side of the housing 100. The well-known structure including the rotating shaft 410, the rotor 420 disposed on an outer circumferential surface of the rotating shaft 410 and the stator 430 in which the rotor 420 is received may be applied to the motor unit 400. Concretely, the motor unit 400 may be a brush motor or a brushless motor.

A bearing 500 is disposed between the pump unit 300 and the motor unit 400 to rotatably support the rotating shaft 410, and a sealing member 600 blocks fluid circulated in the pump unit 300 to prevent fluid from flowing into the motor unit 400.

A second cover 220 is coupled to the other side surface of the housing 100 to seal the motor unit 400, and various electric/electronic devices such as a motor driving unit may be inserted in the housing, if necessary.

In the electric pump according to one embodiment of the present application, since the motor unit 400 and the pump unit 300 formed integrally with the motor unit are accommodated in one housing 100, there is no need to utilize a structure employed for assembling the conventional motor and pump, and therefore assembling reliability is enhanced and an overall size is reduced to enable the compact motor to be manufactured.

The electric pump according to one embodiment of the present application may be operated as an oil pump. If necessary, however, the electric pump of the present application can be modified and utilized as a structure for pumping various kinds of fluids, such as a water pump.

Figure 3:
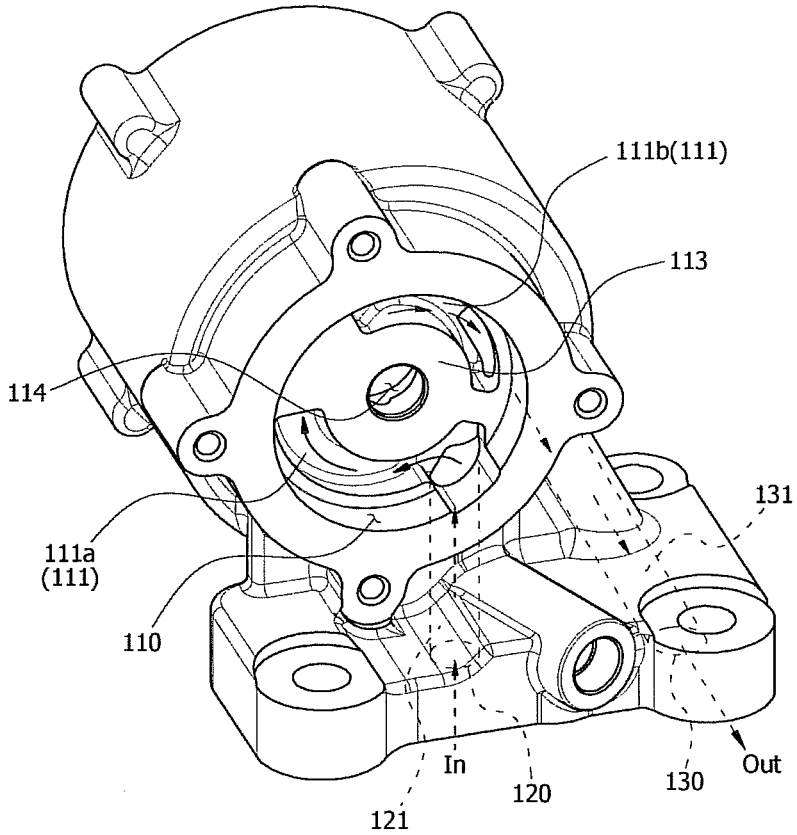
FIG. 3 is a view showing a flow of fluid in an electric pump according to one embodiment of the present application.

FIG. 3 is a view showing a flow of fluid in the electric pump according to one embodiment of the present application.

Referring to FIG. 3, the inserting recess 110 is formed on one side surface of the housing 100 for receiving the pump unit 300 therein, and a main channel 111 is formed on a bottom surface 113 of the inserting recess 110. Fluid is pumped to the main channel 111 by means of a pressure difference caused by rotation of the pump unit 300.

The above main channel 111 may be formed as an elongated groove formed along a circumference of the bottom surface 113 of the housing. On a central portion of the bottom surface 113, in addition, a through hole 114 through which the rotating shaft passes is formed. Therefore, the rotating shaft passes through the through hole 114 and is then coupled to the inner rotor to transmit the rotational force to the pump unit.

Concretely, the main channel 111 may consist of a first main channel 111*a* connected to an end of an inlet channel 121 and a second main channel 111*b* connected to an end of an outlet channel 131.

Therefore, fluid flowed through the fluid inlet 120 by the pump can pass through the inlet channel 121 and enter the first main channel 111*a*, and fluid can be discharged to the second main channel 111*b*, and then pass through the outlet channel 131 and be discharged to the fluid outlet 130.

In the above description, although the first main channel 111*a* and the second main channel 111*b* are exemplarily illustrated, the structure of the above main channel may be variously modified according to a condition such as a coupling location of a transmission. To minimize a length of the channel, in addition, the configuration of the inlet channel 121 and the outlet channel 131 may be variously changed.

Figure 4:
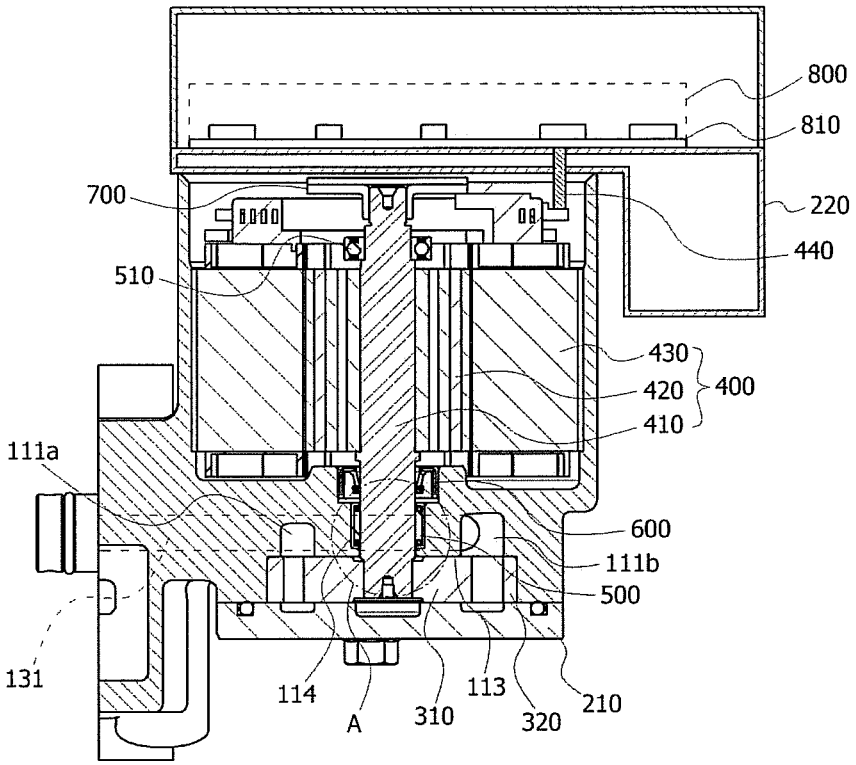
FIG. 4 is a cross sectional view of an electric pump according to one embodiment of the present application.
Figure 5:
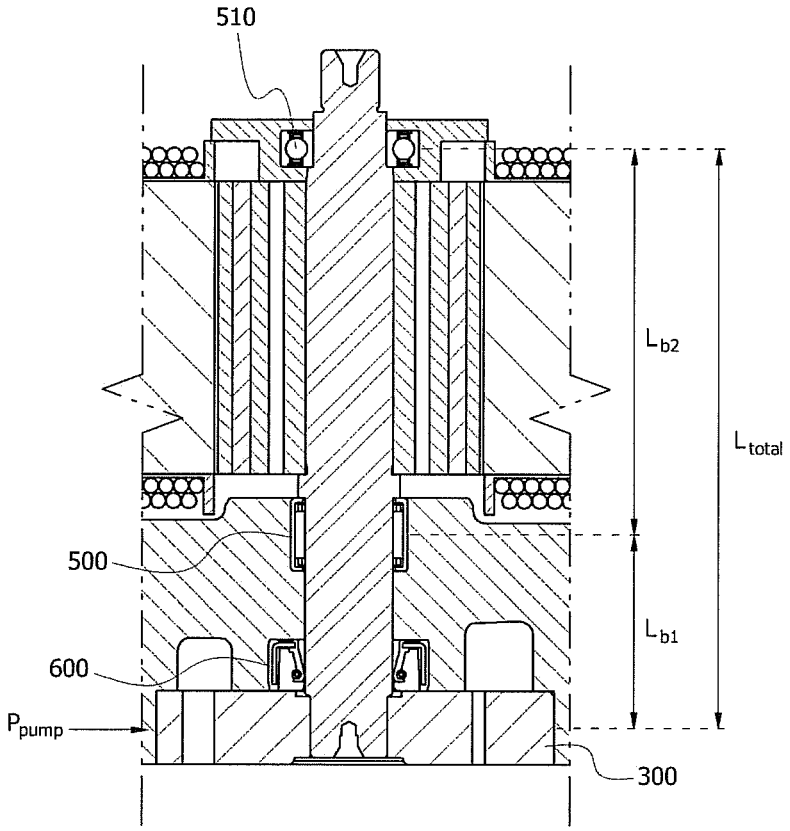
FIG. 5 is a view illustrating locations of a bearing and a sealing member in an electric pump according to one embodiment of the present application.
Figure 6:
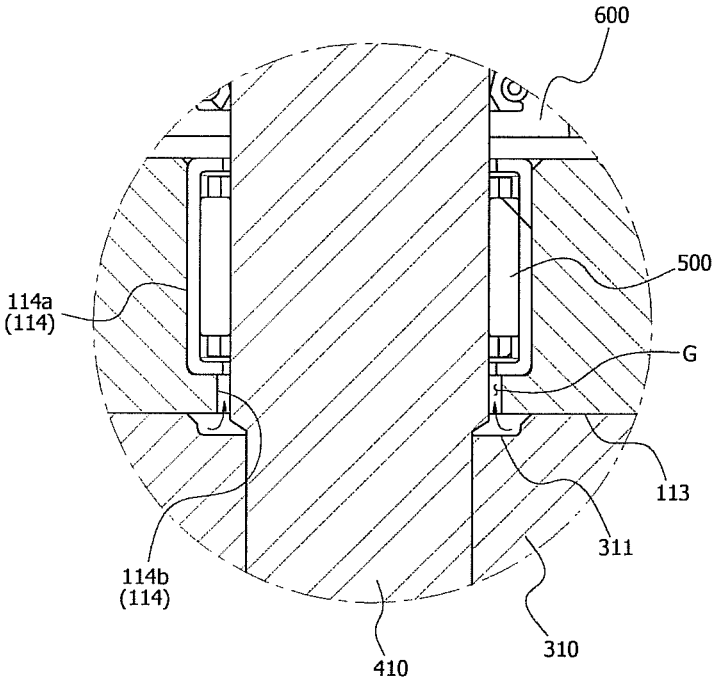
FIG. 6 is an enlarged view of a portion "A" of FIG. 4.

FIG. 4 is a cross sectional view of the electric pump according to one embodiment of the present application, FIG. 5 is a view illustrating locations of the bearing and the sealing member in the electric pump according to one embodiment of the present application, and FIG. 6 is an enlarged view of a portion "A" of FIG. 4.

Referring to FIG. 4, the first bearing 500 is disposed on an inner wall of the through hole 114 through which the rotating shaft 410 passes, and this first bearing rotatably supports one end portion of the rotating shaft 410. Also, a second bearing 510 is disposed on the other end portion of the rotating shaft.

According to the above structure, since the first bearing 500 is disposed close to an end of the rotating shaft 410, the first bearing can stably support rotation of the rotating shaft 410 and an axial load of the rotating shaft 410 can be stably supported by only the first bearing 500 without using an additional bushing. At this time, the first bearing 500 may be designed to have a smaller diameter than the inner rotor 310 of the pump unit 300.

The sealing member 600 is disposed between the first bearing 500 and the motor unit 400 to block an inflow of fluid. A well-know element such as an O-ring may be employed as the sealing member 600. A space in which the first bearing 500 and the sealing member 600 can be installed may be provided on an inner wall of the through hole 114.

According to the present application, since the sealing member 600 is placed between the first bearing 500 and the motor unit 400, it is advantageous to provide the sealing member 600 having an inner diameter equal to or larger than that of the first bearing 500 in terms of blocking an inflow of oil.

Below, the reason why the first bearing 500 is disposed between the pump unit 300 and the sealing member 600 is illustrated. Referring to FIG. 5, when a load is applied to the pump unit 300, the sum of loads applied to the first bearing 500 and the second bearing 510 satisfies the following equation 1.

$$\Sigma P = -P_{pump} + P_{b1} - P_{b2} = 0 \quad \text{Equation 1}$$

Wherein, $P_{pump}$ is the load applied to the pump unit 300, $P_{b1}$ is the load applied to the first bearing 500, and $P_{b2}$ is the load applied to the second bearing 510.

In addition, the sum of the moment $M_{b1}$ of the first bearing and the moment $M_{b2}$ of the second bearing satisfies the following equation 2, and the moment $M_{b1}$ of the first bearing and the moment $M_{b2}$ of the second bearing may be expressed as the following equation 3. Wherein, $L_{b1}$ is the load distance of the first bearing and $L_{total}$ is the total distance.

$$\Sigma M = M_{b1} - M_{b2} = 0 \quad \text{Equation 2}$$

$$(P_{b1} \times L_{b1}) - (P_{b2} \times L_{total}) = 0 \quad \text{Equation 3}$$

Therefore, by substituting equation 3 into equation 1 and arranging the terms, the following equation 4 can be obtained.

$$P_{b1} = P_{pump} \times \frac{L_{total}}{(L_{total} - L_{b1})} \quad \text{Equation 4}$$

Referring to FIG. 5 and equation 4, it can be seen that the load $P_{b1}$ applied to the first bearing is increased in proportion to the load distance $L_{b1}$ of the first bearing. Therefore, it is preferable to reduce the load applied to the first bearing by reducing the load distance of the first bearing 500 and shortening the shaft.

However, if the sealing member 600 is arranged between the first bearing 500 and the pump unit 300 as shown in FIG. 5, the pump unit 300 and the first bearing 500 should be spaced apart from each other by a size of the sealing member 600. As a result, the load of the first bearing 500 is increased in proportion to the separation distance between the pump unit 300 and the first bearing 500, which decreases a lifespan of the pump.

In other words, the first bearing 500 is disposed between the sealing member 600 and the pump unit 300, and it is preferable to dispose the first bearing close to the pump unit 300.

Referring to FIG. 6, the first bearing 500 is disposed in a receiving recess 114*a* provided on an inner wall of the through hole, and a gap G is formed between the inner wall 114*b* of the through hole 114 and the rotating shaft 410.

Therefore, fluid can enter the first bearing 500 via the gap G to perform a lubrication function for the first bearing 500. The inner rotor can be constructed such that a groove 311 is formed at a central portion of a contact surface of the inner rotor 310 to enable fluid to enter the first bearing. If necessary, in addition, a slot is additionally formed on the inner wall 114*b* of the through hole to widen the gap G so that it is possible to increase an inflow of fluid.

Various products can be selected as the first bearing 500 as long as they do not react chemically with grease used therefor. Also, if automatic transmission fluid (ATF) is employed as a fluid, the ATF can sufficiently perform the lubrication function for the bearing.

However, the present application is not limited to the above structure, but can be variously modified. For example, if there is a need to block an inflow of fluid into the first bearing 500, a separate sealing member (not shown) may be provided in the gap G.

Returning to FIG. 4, a sensing unit 700 is a structural element provided for sensing a rotational posture of the rotor 420, and any well-known sensing devices (a resolver and the like) provided in a motor may be adopted as the sensing unit. By means of the second cover 220, in addition, the sensing unit 700 may be sealed in the housing 100.

Thus, according to one embodiment of the present application, all of the pump unit 300, the motor unit 400 and the sensing unit 700 are disposed in one housing 100 to enable the compact structure to be obtained.

According to the present application, a driving unit 800 can be formed integrally with the second cover 220. Since the pump unit 300, the motor unit 400 and the sensing unit 700 are disposed in one housing 100, it is possible to secure a space in which the driving unit 800 can be formed integrally with the housing having a size equal to that of a conventional electric motor.

Concretely, the driving unit 800 may be formed integrally with an upper portion of the second cover 220. However, the present application is not limited thereto, and the driving unit 800 may be formed in an inner space of the second cover 220.

The driving unit 800 includes an inverter for rotating the motor unit 400 and an inverter driving part, a printed circuit board 810 mounted in the inverter is directly connected to u, v and w terminals 440 of the motor unit so that, as compared with a conventional structure utilizing a cable, electrical reliability is enhanced and a more compact structure is obtained. Concretely, the printed circuit board 810 may be directly connected to the u, v and w terminals 440 of the motor unit through soldering.

According to the present application, as compared with a conventional combined type motor and pump, a volume can be reduced by approximately 20 to 25%, and it is possible to mount the inverter in a secured extra space to realize the inverter-integrated pump in a conventional volume.

In addition, a mold for the pump and a mold for the motor are not separately manufactured, but only one mold for the integral type hosing is manufactured so that a production cost can be saved.

Furthermore, an alignment point required for aligning the pump and the motor concentrically is unnecessary so that the electric motor is easily manufactured and a process for manufacturing the electric motor is simplified.

Also, since the motor-integrated pump is manufactured, there is no need to provide a sealing structure between the motor and pump for preventing oil from being leaked.

In addition, the rotating shaft is designed such that a length of the rotating shaft is shortened so that unnecessary torque loss is prevented.

Furthermore, due to the integral type body, the oil flow passage (channel) can be easily secured in the pump.

Also, since the transmission coupling part is close to the center of gravity of the electric pump, the electric pump is resistant to vibration and can be embodied in a low noise design.

In addition, due to the integral type structure, a process for assembling the electric pump is simple and a driving fault or a noise fault caused by inappropriate alignment can be prevented.

The present application is directed to an electric pump which can be manufactured integrally with a motor to enable a structure causing an unnecessary assembling process to be omitted and assembling reliability to be enhanced.

According to an aspect of the present application, there is provided an electric pump comprising a housing; a motor unit including a stator disposed in the housing, a rotor rotatably disposed on the stator and a rotating shaft inserted in and passing through the rotor; and a pump unit comprising an inner rotor coupled to one end of the rotating shaft and an outer rotor. Here, the housing has an inserting recess formed on one side surface thereof for receiving the pump unit.

In the electric pump according to one characteristic of the present application, a main channel is formed on a bottom surface of the inserting recess, the main channel is connected to a fluid inlet and a fluid outlet formed on an outside of the housing, and fluid is pumped to the main channel.

In the electric pump according to one characteristic of the present application, an inlet channel connecting the fluid inlet to the main channel and an outlet channel connecting the fluid outlet to the main channel are formed in the housing.

In the electric pump according to one characteristic of the present application, a through hole is formed at a central portion of the bottom surface of the inserting recess, the rotating shaft passes through the through hole and a bearing is disposed on an inner wall of the through hole to rotatably support the rotating shaft.

In the electric pump according to one characteristic of the present application, a gap is formed between the through hole and the rotating shaft to enable the fluid to enter the bearing.

In the electric pump according to one characteristic of the present application, a sealing member may be disposed between the bearing and the motor unit to block an inflow of fluid.

The electric pump according to one characteristic of the present application includes a first cover coupled to one side surface of the housing to seal the pump unit and a second cover coupled to the other side surface of the housing to seal the motor unit.

In the electric pump according to one characteristic of the present application, a sensing unit is disposed on the other end of the rotating shaft, and the sensing unit is sealed in the housing by the second cover.

The electric pump according to one characteristic of the present application includes a driving unit formed integrally with the second cover to rotate the motor unit.

In the electric pump according to one characteristic of the present application, a circuit board of the driving unit is directly connected to a terminal of the motor unit.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric pump, comprising:

a housing;

a motor including a stator disposed in the housing, a rotor disposed in the stator and a rotating shaft passing through the rotor;

a pump comprising an inner rotor coupled to one end of the rotating shaft and an outer rotor;

a first bearing supporting rotation of the rotating shaft;

a sealing member disposed between the first bearing and the motor; and a second bearing supporting the rotation of the rotating shaft, wherein the housing comprises an inserting recess formed on one side thereof for receiving the pump and a recess portion formed on the other side thereof for receiving the motor unit, wherein a bottom surface of the inserting recess is disposed between the inserting recess and the recess portion and comprises a through hole in which the rotating shaft passes through therein, wherein the through hole includes a first hole having a first diameter, a second hole having a second diameter, and a third hole having a third diameter, wherein the second hole is connected to the first and third holes, wherein the second diameter is smaller than the first diameter, and the second diameter is larger than the third diameter, wherein the sealing member is disposed in the first hole and the first bearing is disposed in the second hole, wherein the third hole includes a gap disposed between an inner circumstance of the third hole and the rotating shaft, wherein the first bearing is disposed at one side of the rotor, and the second bearing is disposed at the other side of the rotor.

2. The electric pump of claim 1, wherein the housing comprises a main channel formed on the bottom surface of the inserting recess, the main channel is connected to a fluid inlet and a fluid outlet formed on an outside of the housing, and fluid is pumped to the main channel.

3. The electric pump of claim 2, wherein the housing comprises an inlet channel connecting the fluid inlet to the main channel and an outlet channel connecting the fluid outlet to the main channel.

4. The electric pump of claim 3, wherein the main channel comprises a first main channel connected to the inlet channel and a second main channel connected to the outlet channel.

5. The electric pump of claim 1, wherein the sealing member has an outer diameter equal to or larger than that of the first bearing.

6. The electric pump of claim 1, wherein the first bearing has an outer diameter smaller than that of the motor.

7. The electric pump of claim 1, further comprising a first cover coupled to one side surface of the housing to seal the pump.

8. The electric pump of claim 7, further comprising a second cover coupled to the other side surface of the housing to seal the motor.

9. The electric pump of claim 8, further comprising a sensing unit disposed on the other end of the rotating shaft, wherein the sensing unit is sealed in the housing by the second cover.

10. The electric pump of claim 8, further comprising an inverter and a circuit board disposed in the second cover.

11. The electric pump of claim 10, wherein a circuit board is directly connected to a terminal of the motor.

* * * * *